US009885480B2

(12) United States Patent
Hasselqvist et al.

(10) Patent No.: US 9,885,480 B2
(45) Date of Patent: Feb. 6, 2018

(54) COMBUSTION CHAMBER OF A COMBUSTOR FOR A GAS TURBINE

(71) Applicant: Siemens Aktiengesellschaft, Munich (DE)

(72) Inventors: Magnus Hasselqvist, Finspong (SE); Frank Rubensdorffer, Hallestad (SE)

(73) Assignee: Siemens Aktiengesellschaft, Munich (DE)

( * ) Notice: Subject to any disclaimer, the term of this patent is extended or adjusted under 35 U.S.C. 154(b) by 241 days.

(21) Appl. No.: 14/369,687

(22) PCT Filed: Dec. 21, 2012

(86) PCT No.: PCT/EP2012/076604
§ 371 (c)(1),
(2) Date: Jun. 28, 2014

(87) PCT Pub. No.: WO2013/102584
PCT Pub. Date: Jul. 11, 2013

(65) Prior Publication Data

US 2014/0373548 A1 Dec. 25, 2014

(30) Foreign Application Priority Data

Jan. 5, 2012 (EP) ..... 12150314

(51) Int. Cl.
*F23R 3/10* (2006.01)
*F01D 9/02* (2006.01)
(Continued)

(52) U.S. Cl.
CPC ..... *F23R 3/10* (2013.01); *F01D 9/023* (2013.01); *F01D 9/06* (2013.01); *F23M 9/06* (2013.01);
(Continued)

(58) Field of Classification Search
CPC .... F23R 3/002; F23R 3/10; F23R 3/16; F23R 3/44; F23R 3/50; F01D 9/06; F01D 9/023
See application file for complete search history.

(56) References Cited

U.S. PATENT DOCUMENTS 3,608,310 A 9/1971 Vaught
5,953,919 A * 9/1999 Meylan ..... F01D 9/023 60/752
(Continued)

FOREIGN PATENT DOCUMENTS

CN 101220965 A 7/2008
CN 101793407 A 8/2010
(Continued)

OTHER PUBLICATIONS

Hasselqvist EP 2100982 A1.*

*Primary Examiner* — Gerald L Sung
*Assistant Examiner* — Scott Walthour
(74) *Attorney, Agent, or Firm* — Beusse Wolter Sanks & Maire

(57) ABSTRACT

A combustion chamber of a combustor for a gas turbine is provided. A combustion chamber includes a plurality of segments arranged annularly about an axis of the combustion chamber, each segment comprising a radial inner wall portion and a radial outer wall portion, a first section comprising an opening for the installation of a burner, and a second section at which at least one airfoil extends between the radial inner wall portion and radial outer wall portion of the segment.

12 Claims, 4 Drawing Sheets

(51) Int. Cl.

| | |
|---|---|
| ***F23R 3/44*** | (2006.01) |
| ***F01D 9/06*** | (2006.01) |
| ***F23M 9/06*** | (2006.01) |
| ***F23R 3/00*** | (2006.01) |
| ***F23R 3/16*** | (2006.01) |
| ***F23M 20/00*** | (2014.01) |
| ***F23R 3/50*** | (2006.01) |

(52) U.S. Cl.

CPC ..... *F23M 20/005* (2015.01); *F23R 3/002* (2013.01); *F23R 3/16* (2013.01); *F23R 3/44* (2013.01); *F23R 3/50* (2013.01); *F23R 2900/00014* (2013.01); *F23R 2900/03043* (2013.01)

(56) References Cited

U.S. PATENT DOCUMENTS

| | | | | |
|---|---|---|---|---|
| 6,047,552 | A * | 4/2000 | Gross | F23R 3/005 165/908 |
| 2001/0003226 | A1* | 6/2001 | Schreiber | F23R 3/002 29/888.01 |
| 2006/0010879 | A1* | 1/2006 | Aumont | F01D 9/023 60/796 |
| 2006/0059913 | A1* | 3/2006 | Bethke | F23M 20/005 60/725 |
| 2007/0113558 | A1 | 5/2007 | Brown | |
| 2007/0283700 | A1 | 12/2007 | Ebel | |
| 2008/0166220 | A1 | 7/2008 | Chen | |
| 2008/0267771 | A1* | 10/2008 | Beeck | F01D 5/146 415/191 |
| 2008/0314044 | A1* | 12/2008 | Bronson | F23R 3/00 60/754 |
| 2009/0026182 | A1* | 1/2009 | Hu | B23K 1/0018 219/121.64 |
| 2010/0104432 | A1* | 4/2010 | Hasselqvist | F01D 5/143 415/191 |
| 2010/0180602 | A1 | 7/2010 | Johnson et al. | |
| 2011/0214429 | A1 | 9/2011 | Chen et al. | |

FOREIGN PATENT DOCUMENTS

| | | | | |
|---|---|---|---|---|
| CN | 102192525 | A | 9/2011 | |
| DE | 102011000879 | A | 9/2011 | |
| EP | 0616111 | A1 | 9/1994 | |
| EP | 2100982 | A1 * | 9/2009 | B23K 35/0261 |

* cited by examiner

COMBUSTION CHAMBER OF A COMBUSTOR FOR A GAS TURBINE

CROSS REFERENCE TO RELATED APPLICATIONS

This application is the US National Stage of International Application No. PCT/EP2012/076604 filed Dec. 21, 2012, and claims the benefit thereof. The International Application claims the benefit of European Application No. EP12150314 filed Jan. 5, 2012. All of the applications are incorporated by reference herein in their entirety.

FIELD OF INVENTION

The present invention relates to a combustor and more particularly to combustion chamber of a gas turbine.

BACKGROUND OF INVENTION

In gas turbines, fuel is delivered from a source of fuel to a combustor where the fuel is mixed with air and ignited to produce hot combustion products which are generally known as working gases. As will be appreciated, the amount of working gas produced depends on a proper and effective mixing of the fuel and air in the combustor.

DE 10 2011 000879 A1 discloses a combustor for a gas turbine. The combustor comprises a combustion chamber in which a working medium consisting of fuel and air is mixed and subsequently burned. The air intake of cooling air into an annular channel is allowed by an outer shell in which airfoils allow to guide incoming air to have a swirl when entering that annular channel.

Currently, swirlers are used in the combustor to generate swirls in the air so that the air is properly mixed with fuel. Proper mixing of the fuel and air results in increasing the efficiency of gas turbine since the generation of the working gas by subsequent burning of the fuel and air mixture is more efficient. This also reduces the amount of NOx gases produced from the burning of the fuel and air mixture.

Burners with swirlers are widely known. Nevertheless several problems may occur in known combustion chambers, like the combustion chamber of DE 10 2011 000879 A1. For example pulsation and vibrations may occur within the combustion chamber. Furthermore it may be a disadvantage that the combusted fluid may be turbulent or may just be guided by a combustion liner such that the angle of attack on subsequent turbine vanes or blades is not optimal.

SUMMARY OF INVENTION

It is therefore an object of the present invention to provide an improved arrangement in a combustor to overcome the mentioned problems.

The object is achieved by providing a combustion chamber for a combustion chamber, a combustor, and a gas turbine according to the claims.

The present invention provides the combustion chamber for the combustor for a gas turbine which is an annular combustion chamber including a plurality of segments arranged annularly about an axis of the combustion chamber, each segment comprising a radial inner wall portion and a radial outer wall portion, a first section comprising an opening for the installation of a burner, and a second section at which at least one airfoil extends between the radial inner wall portion and radial outer wall portion of the segment. The first section and the second section are located at opposing first end and second end of the combustion chamber. By having the burner and the airfoil at respective first section and second section, which correspond to the opposing first end and second end of the combustion chamber space for mixing of fuel and air is increased. In addition the airfoil increases the swirling in the air passing through it which increases the mixing of fuel and air. The airfoil present at the second end guides the working medium through an exit located at the second end of the combustion chamber.

Each segment comprises an inner surface and an outer surface with a channel for air defined between the inner and outer surface, wherein air in the channel is conducted from the airfoil. Such an arrangement ensures that air and fuel are properly mixed inside the combustor.

Herein, compressed air from a compressor of the gas turbine is directed into the airfoil.

In one embodiment, the segment includes at least one air inlet at the second section wherein the airfoil is located such that air entering the segment through the air inlet is swirled. This arrangement increases the mixing between the fuel and the air due to increase in swirl of the air.

In one embodiment, the first section and the second section are located at the first end and the second end of the combustion chamber, this increase space for effective mixing of the fuel with air.

In one embodiment, the airfoil and the wall portion are formed of one piece of a material which increases the dimensional stability of the segment.

In one embodiment, the airfoil and the wall portion are cast which obviates the need for machining and welding. In addition, the airfoil and the wall portion would be a single piece and would exhibit uniform properties with increased strength.

In another embodiment, two adjacent segments are assigned to one burner, which enables greater mixing of air with the fuel which then is then ignited by the burner.

In another embodiment, each segment comprises two airfoils to increase the swirling of air in the combustion chamber.

In one embodiment, the outer surface of the segment is brazed which ensures that the air from the compressor is kept within the combustor.

In one embodiment, the airfoil and the wall portions are formed from an alloy, which increases strength of the segment and are capable of withstanding high temperatures.

In one embodiment, the alloy is Nickel based gamma prime strengthened alloy. The creep strength of this type of casting alloy is significantly higher than those in traditional combustor alloys which results in improved dimensional stability. In addition, gamma prime alloy is ductile and thus imparts strength to the matrix without lowering the fracture toughness of the alloy.

In another embodiment, the alloy is IN738LC. IN738LC is a nickel based superalloy which exhibits compatibility with currently used thermal barrier coating systems.

In another embodiment, the alloy is CM247CC. CM247CC is also a nickel based superalloy which is also compatible with currently existing thermal barrier coating systems, as well as the ability to form a layer of protective alumina which provides a significant improvement in oxidation resistance as compared to other alloys.

The above-mentioned and other features of the invention will now be addressed with reference to the accompanying drawings of the present invention. The illustrated embodiments are intended to illustrate, but not limit the invention.

The drawings contain the following figures, in which like numbers refer to like parts, throughout the description and drawings.

DETAILED DESCRIPTION OF INVENTION

Figure 1:
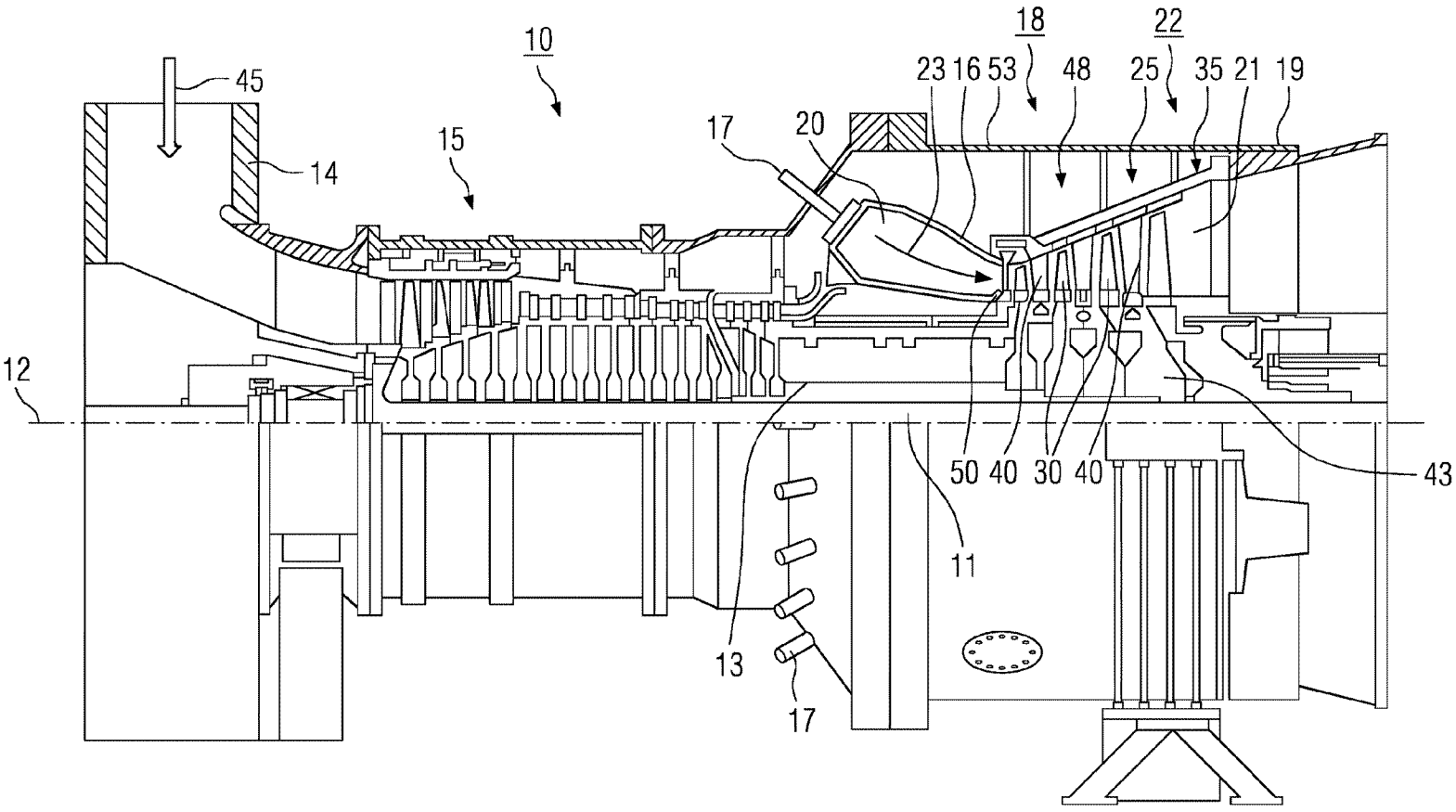
FIG. 1 is a schematic diagram of a gas turbine.

FIG. 1 is a schematic diagram of a gas turbine 10 depicting internal components. The gas turbine 10 includes a rotor 13 which is mounted such that it can rotate along an axis of rotation 12, has a shaft 11 and is also referred to as a turbine rotor.

The gas turbine 10 includes an intake housing 14, a compressor 15, a combustor 16 having a combustion chamber 20, a turbine 18, and an exhaust-gas housing 19 following one another along the rotor 13. The combustion chamber 20 is an annular combustion chamber with a plurality of coaxially arranged burners 17.

The annular combustion chamber 20 is in communication with an annular hot-gas passage 21, where, by way of example, four successive turbine stages 22 form the turbine 18.

It may be noted that each turbine stage 22 is formed, for example, from two blade or vane rings. As seen in the direction of flow of a working medium 23 from the combustion chamber 20 to the turbine 18, in the hot gas passage 21 a row 25 of guide vanes 40 is followed by a row 35 formed from rotor blades 30. The guide vanes 40 are secured to an inner housing 48 of a stator 53, whereas the rotor blades 30 of the row 35 are fitted to the rotor 13 for example by means of a turbine disk 43.

A generator not shown in FIG. 1 is coupled to the rotor 13. During the operation of the gas turbine 10, the compressor 15 sucks in air 45 through the intake housing 14 and compresses it. The compressed air provided at the turbine-side end of the compressor 15 is passed to the burners 17, where it is mixed with a fuel. The mix is then burnt in the combustion chamber 20, forming the working medium 23. From there, the working medium 23 flows along the hot-gas passage 21 past the guide vanes 40 and the rotor blades 30. The working medium 23 is expanded at the rotor blades 30, transferring its momentum, so that the rotor blades 30 drive the rotor 13 and the latter in turn drives the generator coupled to it.

In addition, while the gas turbine 10 is in operation, the components which are exposed to the hot working medium 23 are subjected to thermal stresses. The guide vanes 40 and the rotor blades 30 of the first turbine stage 22, as seen in the direction of flow of the working medium 23, together with the heat shield bricks which line the annular combustion chamber 20, are subject to the highest thermal stresses. These components are typically cooled by a coolant, such as oil.

As will be appreciated, the components of the gas turbine 10 are made from a material such as superalloys which are iron-based, nickel-based or cobalt-based. More particularly, the turbine vanes 40 and/or blades 30 and components of the combustion chamber 20 are made from the superalloys mentioned hereinabove.

The combustion chamber 20 which is an annular combustion chamber 20 in the presently contemplated configuration includes a multiplicity of burners 17 arranged circumferentially around the axis of rotation 12 and open out into a common combustion chamber space and generates flames. To achieve a high efficiency, the combustion chamber 20 is designed for a temperature of the working medium 23 of approximately 1000 degree Celsius to 1600 degree Celsius. To allow a long service life even with these operating parameters, which are unfavorable for the materials, the combustion chamber wall is provided, on its side which faces the working medium 23, with an inner lining formed from heat shield elements.

Figure 2:
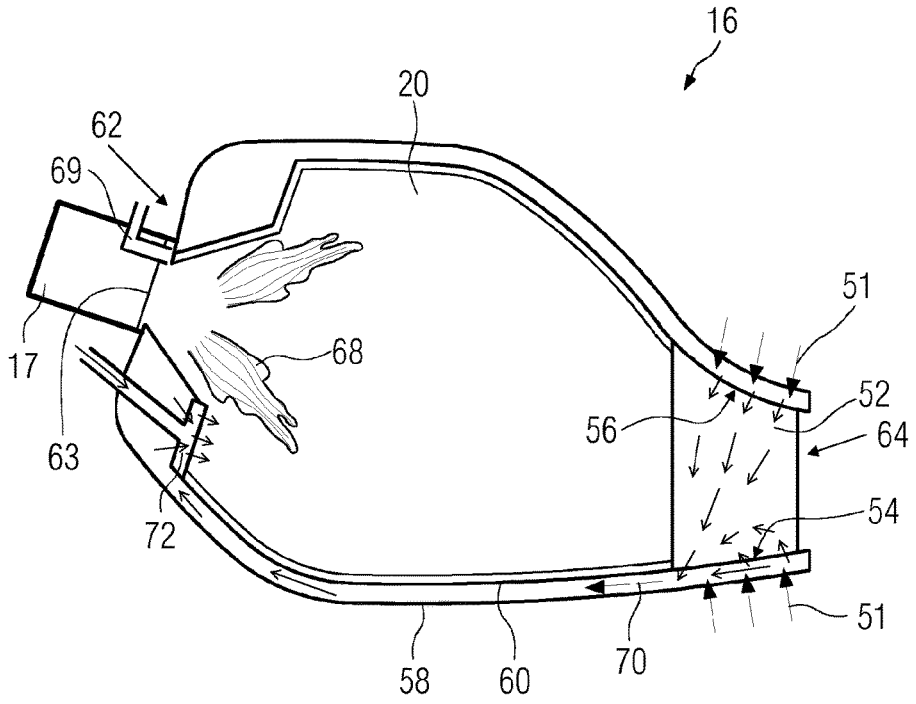
FIG. 2 is a schematic diagram of a combustor and its combustion chamber, in accordance with aspects of the present technique.

Referring now to FIG. 2, a schematic diagram of the combustor 16 and its combustion chamber 20, respectively, is depicted in accordance with aspects of the present technique. The combustor 16 includes the combustion chamber 20 which in the presently contemplated configuration is an annular combustion chamber which includes a plurality of segments arranged circumferentially around the axis 12. FIG. 2 shows a cross section through one of those segments. As an example, a total of twenty segments would form the combustion chamber 20. Each segment includes an inner wall portion 54 and an outer wall portion 56.

It may be noted that the inner wall portion 54 and the outer wall portion 56 are positioned radially outwards from the axis 12.

In accordance with aspects of the present technique, the segment has a first section 62 and a second section 64, with the burner installed at an opening 63 at the first section 62 and an airfoil 52 such as a guide vane at the second section 64.

It may be noted however, that the first section may be at the first end and the second section may be at the second end, wherein the first end and the second end are opposing each other. For the purpose of explanation the terms "first section" and "first end" and the "second section" and "second end" are used interchangeably.

As previously noted, the combustion chamber 20 includes the opening 63 at the first end 62 as depicted in FIG. 2. A burner 17 is installed at the opening 63 at the first end 62. Air from the compressor 15 is directed via a panel 72 and through the airfoil 52 in to the combustion chamber 20 and mixed with fuel. Fuel is directed into the combustion chamber via a fuel pipe 69. The air and fuel mixture is ignited by the burner 17 to produce the working medium 23.

In accordance with aspects of the present technique, the airfoil 52 is present at the second end 64. The airfoil 52 extends between the inner wall portion 54 and an outer wall portion 56. The compressed air from the compressor 15 is directed into the airfoil 52 as indicated by reference numeral 51. Air 51 in the airfoil 52 could also be swirled to create turbulence.

The combustor segment includes an inner surface 60 and an outer surface 58 forming a channel 70 there between to conduct air from the airfoil 52 to the channel 70. Air is mixed with a fuel supplied through the fuel pipe 69 and is ignited by the burner 17 to generate flames 68 and hence produce the working medium 23 for the turbine. This working medium 23 is guided through an exit by the airfoil 52 present at the second end 64 out of the combustion chamber 20.

Additionally the combustor 16 may include cooling holes, or cooling pipes at the end walls to supply cooling air to cool the walls of the combustion chamber 20.

As previously noted, the panel 72 is located at the first section or the first end 62 inside the combustion chamber 20 which acts as a Helmholtz panel to draw air into the combustion chamber 20. The panel 72 alongwith the airfoil 52 acts as a Helmholtz resonator and will keep the air inside the chamber 20 to ensure effective mixing of the air with the fuel and hence better combustion is achieved.

Figure 3:
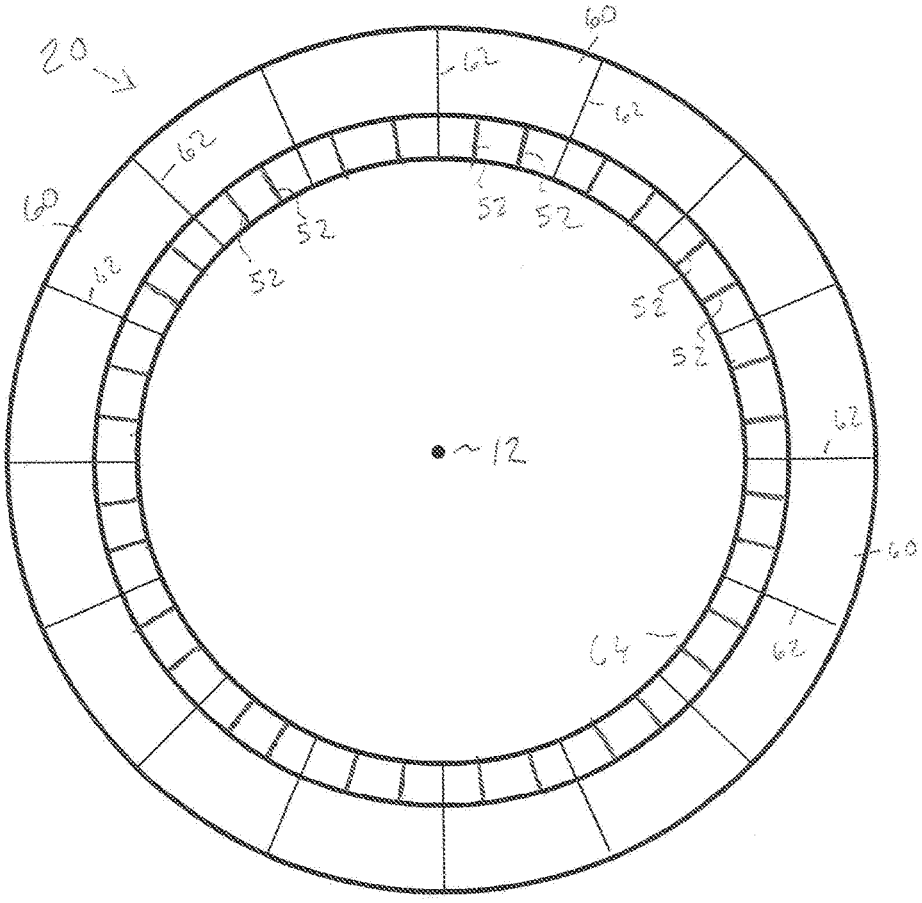
FIG. 3 is a schematic end view of the annular combustor looking at a second section.
Figure 4:
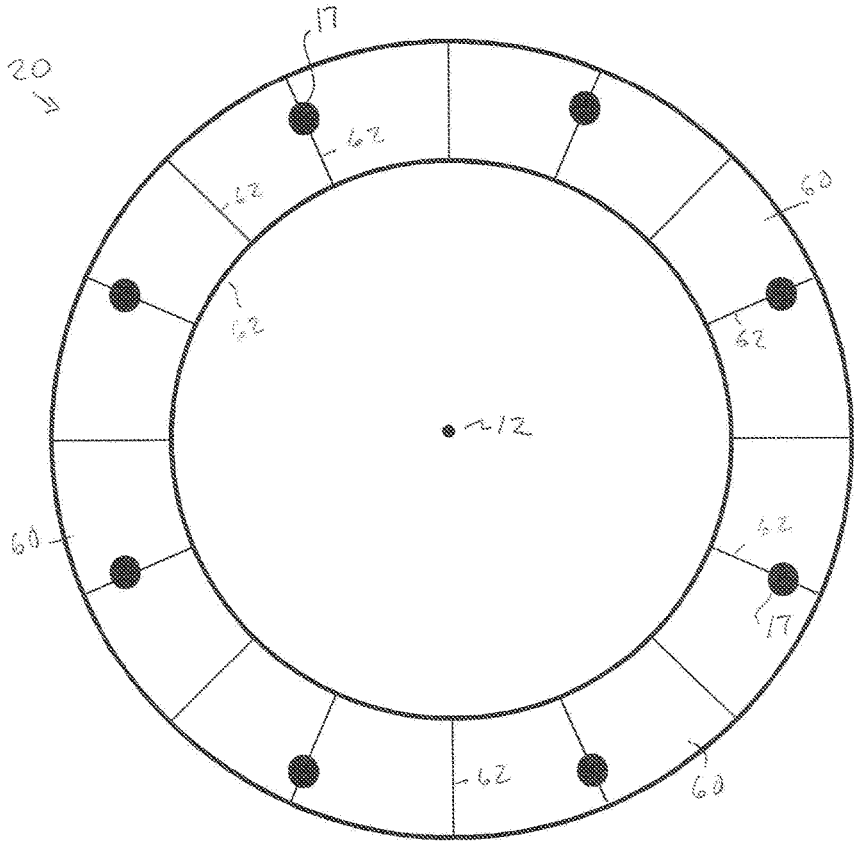
FIG. 4 is a schematic end view of the annular combustor looking at a first section.

FIG. 3 is an end view of the annular combustor 16 looking upstream at the second section 64. FIG. 4 is an end view of the annular chamber 16 looking downstream at the first section 62. As previously noted and as can be seen in FIGS. 3 and 4, the combustion chamber 20 includes a plurality of segments 60 separated at respective interfaces 62. In FIG. 3 an example embodiment having sixteen segments 60 are shown. The segments 60 are arranged adjacent to each other in a manner such that two segments 60 are assigned to one burner 17. In addition, each segment 60 includes two airfoils 52 located adjacent to each other. The inner wall portion 54, the outer wall portion 56 and the airfoil 52 in a segment 60 are formed of one piece of a material. More particularly, the airfoil 52, the inner wall portion 54 and the outer wall portion 56 are cast to produce a single piece material.

In accordance with the aspects of the present technique, the airfoil 52 and the wall portions 54, 56 are made of material such as alloys, for example nickel-based superalloy. These alloys are capable of withstanding high temperatures which may exceed 650 degree centigrade. The airfoil 52 and the wall portions 54, 56 are cast from the same type of alloy such as, Nickel-based gamma prime strengthened alloy.

It may be noted that the inner wall 54 and the outer wall 56 may be coated with a thermal barrier coating to protect against the high temperatures of the hot gas. Hence it may be noted that the alloys in the present technique are chosen which are compatible with the thermal barrier coatings. Furthermore, it may be noted that alloys such as Nickel-based gamma prime strengthened alloys include a higher quantity of aluminum than the traditional alloys used in the combustors. The presence of aluminum increases the life time of the thermal barrier coatings that are applied to the wall.

Additionally, the alloys for casting the segments of the combustion chamber are chosen which have a better castability and are capable of casting large components such as the segments of combustion chamber 20, such as IN738LC, which is a nickel-based super alloy and has a chemical composition in wt % as Cobalt 8.59, Chromium 16.08, Aluminum 3.43, Silicon 0.18, Carbon 0.11, Phosphorus 0.01, Iron 0.50, Boron 0.05, Sulfur 0.01, Tungsten 2.67, Tantalum 1.75, Nobelium 0.90, Titanium 3.38, Manganese 0.03, Copper 0.03 and Nickel as remaining.

Alternatively, alloy such as CM247CC, which is also a nickel based superalloy may be used for casting the segment. This alloy has a composition in wt % as Cobalt 10, Chromium 8, Molybdenum 0.5, Tungsten 9.5, Aluminum 5.65, Tantalum 3, Hafnium 1.5, Zirconium 0.1, Carbon 0.1 and Nickel as remaining.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the embodiments of the present invention as defined.

The invention claimed is:

1. A combustion chamber for an annular combustor for a gas turbine, comprising:

a plurality of segments arranged annularly about an axis of the combustion chamber, each segment comprising:

a radial inner wall portion and a radial outer wall portion, a first section comprising an opening for the installation of a burner, and a second section at which at least one airfoil connects the radial inner wall portion and the radial outer wall portion of the segment, wherein the inner wall portion, the outer wall portion, and the at least one airfoil are cast to form a one-piece body, wherein the at least one airfoil comprises a first end located at the radial inner wall portion and a second end located at the radial outer wall portion, and wherein the at least one airfoil extends continuously between the first and second ends of the at least one airfoil;

wherein the first section and the second section are located respectively at a first end and an opposing second end of the combustion chamber, wherein each segment further comprises an inner surface and an outer surface with a channel defined between the inner surface and the outer surface, wherein compressed air from a compressor of the gas turbine is directed into the at least one airfoil, wherein compressed air from the at least one airfoil is conducted into the channel, and wherein the at least one airfoil is located at the opposing second end of the combustion chamber and guides a working medium through an exit located at the opposing second end of the combustion chamber.

2. The combustion chamber according to claim 1, wherein the opposing second end of the combustion chamber is located downstream from the first end of the combustion chamber.

3. The combustion chamber according to claim 1, wherein each segment comprises two airfoils, the two airfoils extending between a respective radial inner wall portion and a respective radial outer wall portion.

4. The combustion chamber according to claim 1, wherein the outer surface is brazed.

5. The combustion chamber according to claim 1, further comprising a panel located at the first end of the combustion chamber for drawing compressed air into the combustion chamber.

6. The combustion chamber according to claim 5, wherein the panel along with the at least one airfoil acts as a Helmholtz resonator that is effective to ensure effective mixing of compressed air in the combustion chamber with fuel in the combustion chamber.

7. The combustion chamber according to claim 1, wherein the at least one airfoil and the radial inner wall portion and the radial outer wall portion are formed from an alloy.

8. The combustion chamber according to claim 7, wherein the alloy is one of a Nickel based gamma prime strengthened alloy, IN738LC, and CM247CC.

9. The combustion chamber according to claim 1, wherein two adjacent segments of the plurality of segments are assigned to one burner.

10. A combustor comprising a combustion chamber according to claim 1.

11. A gas turbine, comprising a combustor comprising the combustion chamber according to claim 1.

12. A combustion chamber for an annular combustor for a gas turbine, comprising:

a plurality of segments arranged annularly about an axis of the combustion chamber, each segment comprising:

a radial inner wall portion and a radial outer wall portion, a first section comprising an opening for the installation of a burner, and a second section at which at least one airfoil connects the radial inner wall portion and the radial outer wall portion of the segment;

wherein the inner wall portion, the outer wall portion, and the at least one airfoil are cast to form a one-piece body, and wherein the at least one airfoil comprises a first end located at the radial inner wall portion and a second end located at the radial outer wall portion, and wherein the at least one airfoil extends continuously between the first and second ends of the at least one airfoil, wherein the first section and the second section are located respectively at a first end and an opposing second end of the combustion chamber, wherein each segment further comprises an inner surface and an outer surface with a channel defined between the inner surface and the outer surface, and wherein each segment is configured to direct compressed air originating from a compressor of the gas turbine into the at least one airfoil at a location at which the at least one airfoil interfaces with the radial outer wall portion, to direct compressed air out of the at least one airfoil into the channel in the radial inner wall portion, and to direct compressed air out of the channel in the radial inner wall portion and into the combustion chamber through an exit located at the second end of the combustion chamber.

* * * * *